US011437734B2

(12) United States Patent
Goto et al.

(10) Patent No.: US 11,437,734 B2
(45) Date of Patent: Sep. 6, 2022

(54) ANTENNA DEVICE AND ARRAY ANTENNA

(71) Applicant: Mitsubishi Electric Corporation, Tokyo (JP)

(72) Inventors: Jun Goto, Tokyo (JP); Takashi Maruyama, Tokyo (JP); Toru Fukasawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 11 days.

(21) Appl. No.: 17/033,143

(22) Filed: Sep. 25, 2020

(65) Prior Publication Data

US 2021/0013627 A1 Jan. 14, 2021

Related U.S. Application Data

(63) Continuation of application No. PCT/JP2018/019860, filed on May 23, 2018.

(51) Int. Cl.

*H01Q 21/08* (2006.01)
*H01Q 1/48* (2006.01)
*H01Q 13/10* (2006.01)

(52) U.S. Cl.

CPC ..... *H01Q 21/08* (2013.01); *H01Q 1/48* (2013.01); *H01Q 13/106* (2013.01)

(58) Field of Classification Search

CPC .... H01Q 21/062; H01Q 21/08; H01Q 13/106; H01Q 9/285; H01Q 21/12; H01Q 21/0043; H01Q 21/005; H01Q 21/065; H01Q 21/067; H01Q 21/068; H01Q 21/10; H01Q 21/14

See application file for complete search history.

(56) References Cited

U.S. PATENT DOCUMENTS 4,426,649 A * 1/1984 Dubost ..... H01Q 21/062 343/803
6,087,989 A * 7/2000 Song ..... H01Q 21/08 343/803
6,239,764 B1 * 5/2001 Timofeev ..... H01Q 9/065 343/810
2013/0009833 A1 * 1/2013 Kough ..... H01Q 13/10 343/770

(Continued)

FOREIGN PATENT DOCUMENTS

JP 10-303636 A 11/1998
JP 2003-168922 A 6/2003

(Continued)

OTHER PUBLICATIONS

Extended European Search Report for European Application No. 18919437.6, dated Mar. 10, 2021.

(Continued)

*Primary Examiner* — Ricardo I Magallanes
(74) *Attorney, Agent, or Firm* — Birch, Stewart, Kolasch & Birch, LLP

(57) ABSTRACT

This antenna device is provided with: a ground; strip lines that extend from positions facing each other with respect to the width direction of the ground; a plurality of slots which is provided to the ground and which intersects with straight lines along the strip lines; and branch lines which intersect with the slots that are positioned to face the branch lines in a back surface.

12 Claims, 7 Drawing Sheets

(56) References Cited

U.S. PATENT DOCUMENTS

| | | | | |
|---|---|---|---|---|
| 2014/0071009 | A1* | 3/2014 | Cheng | H01Q 13/16<br>343/770 |
| 2014/0104157 | A1* | 4/2014 | Burns | H01Q 1/243<br>343/702 |
| 2020/0106194 | A1* | 4/2020 | Takaki | H01Q 9/0457 |

FOREIGN PATENT DOCUMENTS

| | | | |
|---|---|---|---|
| JP | 2007-28294 | A | 2/2007 |
| JP | 2013-236349 | A | 11/2013 |

OTHER PUBLICATIONS

International Search Report issued in PCT/JP2018/019860 (PCT/ISA/210), dated Jul. 31, 2018.
Office Action for Japanese Patent Application No. 2018-553256, dated Nov. 6, 2018.

* cited by examiner

ANTENNA DEVICE AND ARRAY ANTENNA

CROSS REFERENCE TO RELATED APPLICATION

This application is a Continuation of PCT International Application No. PCT/JP2018/019860, filed on May 23, 2018, which is hereby expressly incorporated by reference into the present application.

TECHNICAL FIELD

The present invention relates to an antenna device including a dipole array antenna.

BACKGROUND ART

Conventionally, a dipole array antenna that radiates a polarized wave parallel to a signal line is known (see, for example, Patent Literature 1).

CITATION LIST

Patent Literatures

Patent Literature 1: JP 2003-168922 A

SUMMARY OF INVENTION

Technical Problem

The dipole array antenna disclosed in Patent Literature 1 is a traveling-wave dipole array antenna in which electric power is distributed to a plurality of dipole elements from a microstrip line by an impedance transformer. In the dipole array antenna disclosed in Patent Literature 1, the dipole elements are arranged on two signal lines, one signal line provided on the front surface of a substrate and other signal line provided on the back surface of the substrate at a corresponding position of the signal line on the front surface.

When the dipole array antenna disclosed in Patent Literature 1 is excited, a polarized wave parallel to the signal line is radiated in a broadside direction. In order to radiate a polarized wave perpendicular to the signal line with such a dipole array antenna, it is necessary to connect the dipole element rotated by 90 degrees to the microstrip line via a bypass line such as a bending structure. With this structure, a transmission loss is increased particularly in a high frequency band.

As described above, the dipole array antenna disclosed in Patent Literature 1 has a problem in that a transmission loss is large when a polarized wave perpendicular to the signal line is radiated as an electromagnetic wave in the broadside direction.

The present invention is intended to solve the above problem, and an object of the present invention is to provide an antenna device capable of efficiently radiating a polarized wave perpendicular to a signal line in the broadside direction.

Solution to Problem

The antenna device according to the present invention includes: a first ground provided on a first surface and having a strip shape; a plurality of first strip lines provided on the first surface, each of the first strip lines being disposed along a longitudinal direction of the first ground; a plurality of holes provided in the first ground; a signal line provided on a second surface facing opposite to the first surface, the signal line disposed at a position corresponding to the first ground, and through which a high frequency wave propagates; a plurality of branch lines provided on the second surface and branched from the signal line. The strip shape of the first ground is parallel to the signal line. Each of the first strip lines is a strip line extending from the first ground. Each of the holes intersects with a straight line along a corresponding one of the first strip lines. Each of the branch lines is disposed along a longitudinal direction of the first ground with respect to the signal line and intersects with a corresponding one of the holes located on the first surface when viewed transparently from the second surface side.

Advantageous Effects of Invention

According to the present invention, the antenna device includes: a first ground having a strip shape, a signal line through which a high frequency wave propagates and the first ground being parallel; a plurality of first strip lines extending from the first ground and a plurality of branch lines branched from the signal line, each of the first strip lines and the branch lines being disposed along a longitudinal direction of the first ground; and a plurality of holes, each of the holes intersecting with a straight line along a corresponding one of the first strip lines and with the branch line at the corresponding position. As a result, a current in the branch portions where the branch lines are branched from the signal line is increased, and the strip lines are supplied with electric power by electromagnetic coupling using the holes. Therefore, the antenna device can efficiently radiate a polarized wave perpendicular to the signal line in the broadside direction.

DESCRIPTION OF EMBODIMENTS

In order to describe the present invention in more detail, a mode for carrying out the present invention will now be described with reference to the accompanying drawings.

First Embodiment

Figure 1A:
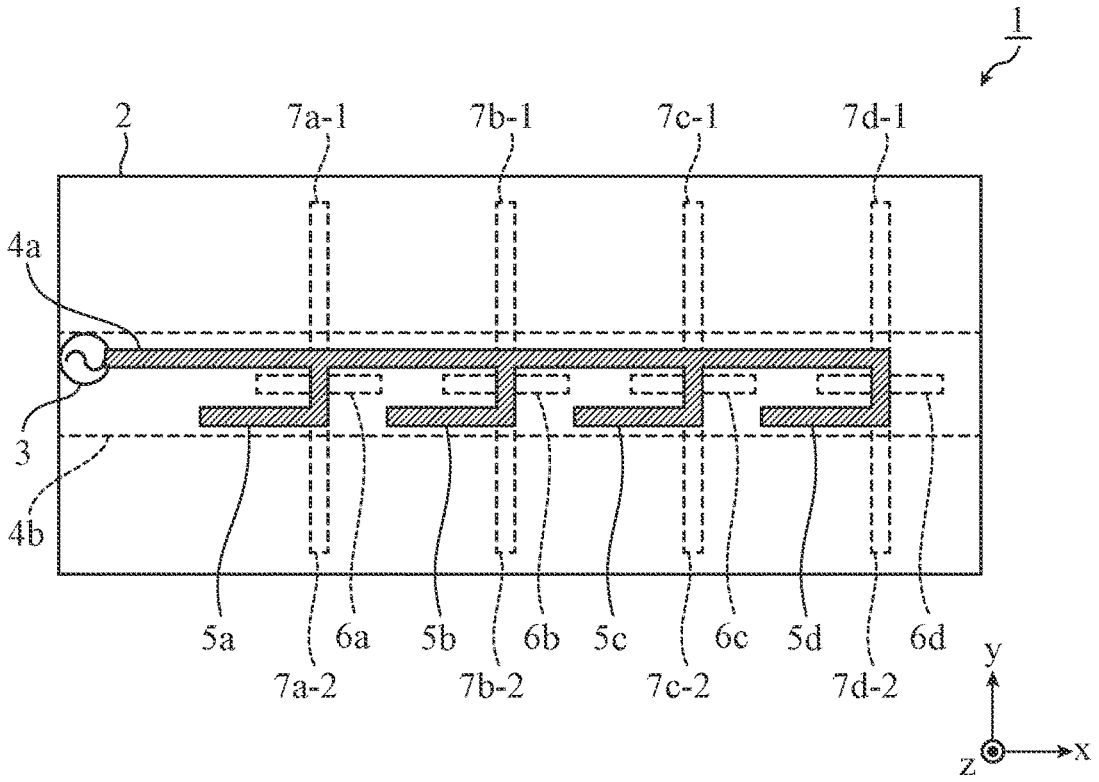
FIG. 1A is a plan view showing a configuration on the front surface side of an antenna device according to a first embodiment of the present invention.
Figure 1B:
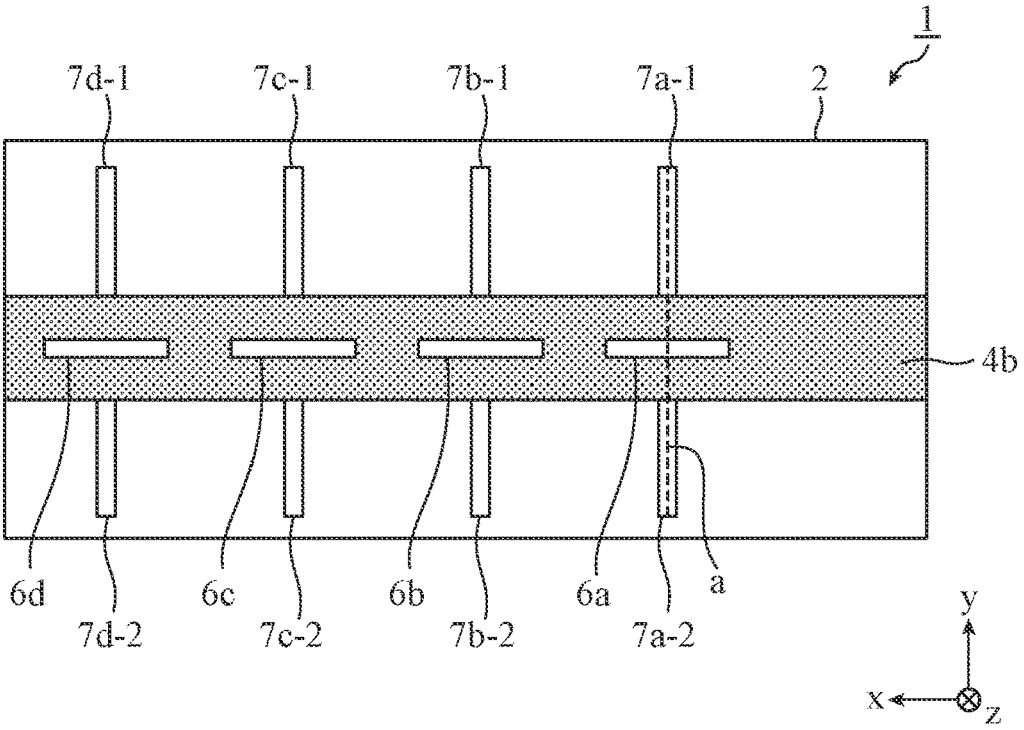
FIG. 1B is a plan view showing a configuration on the back surface side of the antenna device according to the first embodiment of the present invention.

FIG. 1A is a plan view showing the configuration on the front surface side of an antenna device 1 according to the first embodiment of the present invention, and shows the front surface of the antenna device 1. FIG. 1B is a plan view showing the configuration on the back surface side of the antenna device 1 according to the first embodiment of the present invention, and shows the back surface of the antenna device 1. Note that, in FIG. 1A, the elements on the back surface side are indicated by broken lines in order to show the positional relationship between the elements on the back surface side and the elements on the front surface side of the antenna device 1. In a case where one of surfaces of a dielectric substrate 2 is defined as the back surface and the other surface of the dielectric substrate 2 is defined as the front surface, the back surface of the dielectric substrate 2 is defined as a first surface, and the front surface of the dielectric substrate 2 is defined as a second surface.

The antenna device 1 shown in FIG. 1 includes the dielectric substrate 2 which is a first dielectric substrate, and conductor patterns formed on both surfaces of the dielectric substrate 2. As shown in FIG. 1A, a feed 3, a signal line 4*a*, and branch lines 5*a* to 5*d* are provided on the front surface of the dielectric substrate 2. As shown in FIG. 1B, a ground 4*b* is provided on the back surface of the dielectric substrate 2. The ground 4*b* is provided with slots 6*a* to 6*d*. Further, strip lines 7*a*-1 and 7*a*-2, strip lines 7*b*-1 and 7*b*-2, strip lines 7*c*-1 and 7*c*-2, and strip lines 7*d*-1 and 7*d*-2 are provided on the back surface of the dielectric substrate 2.

The feed 3 is connected to the signal line 4*a*. The antenna device 1 is supplied with power from the feed 3. The signal line 4*a* is a line through which a high frequency power input to the feed 3 propagates, and is also called an electric supply line. The feed 3 shown in FIG. 1A is on the right side of the dielectric substrate 2 in FIG. 1B showing the back surface side. The ground 4*b* is a first ground having a strip shape parallel to the signal line 4*a*, and has a width smaller than the length of a dipole constituted by the strip line 7*a*-1 and the strip line 7*a*-2 via the ground 4*b*. The length of the dipole is a half the wavelength of the working frequency of the antenna device 1. Further, as shown in FIG. 1A, the signal line 4*a* is provided on the front surface of the dielectric substrate 2 at a position corresponding to the ground 4*b*.

Each of the branch lines 5*a* to 5*d* is a line branched from the signal line 4*a*, and has a shape in which, for example, the leading end of a strip-shaped conductor pattern extending from the signal line 4*a* is bent toward the feed 3. Further, each of the branch lines 5*a* to 5*d* has a length one-fourth the wavelength of the working frequency of the antenna device 1, and operates as an open stub. Each of the slots 6*a* to 6*d* is a hole provided along the longitudinal direction of the ground 4*b*, and has, for example, a rectangular hole shape that is long along the longitudinal direction of the ground 4*b*. Each of the slots 6*a* to 6*d* has a length 0.32 times the wavelength of the working frequency of the antenna device 1, and a width 0.026 times the wavelength of the working frequency of the antenna device 1.

As shown in FIG. 1B, the strip lines 7*a*-1 to 7*d*-1 and the strip lines 7*a*-2 to 7*d*-2 are first strip lines extending from positions opposite to each other with respect to the width direction of the ground 4*b*. For example, each of the strip lines 7*a*-1 to 7*d*-1 and the strip lines 7*a*-2 to 7*d*-2 has a length 0.10 times the wavelength of the working frequency of the antenna device 1, and has a width 0.026 times the wavelength. The strip lines 7*a*-1 to 7*d*-1 and the strip lines 7*a*-2 to 7*d*-2 are sequentially arranged along the longitudinal direction of the ground 4*b* on the back surface of the dielectric substrate 2. In FIG. 1B, a straight line a indicated by a broken line is a straight line along the first strip line, and this straight line a is orthogonal to the ground 4*b*. The spacing between the adjacent strip lines such as the strip line 7*a*-1 and the strip line 7*b*-1 has a length 0.64 times the wavelength of the working frequency of the antenna device 1.

As shown in FIG. 1A, the branch lines 5*a* to 5*d* and the slots 6*a* to 6*d* are located on the different side of the dielectric substrate 2. Each of the branch lines 5*a* to 5*d* intersects the corresponding slot 6*a* to 6*d* when viewed transparently. For example, the branch line 5*a* intersects with the corresponding slot 6*a* located on the back surface of the dielectric substrate 2, when viewed transparently from the front surface side. Each of the relations between the branch lines 5*b* to 5*d* and the slots 6*b* to 6*d* is similar to the above mentioned relation. As shown in FIG. 1B, the slots 6*a* to 6*d* are perpendicular to the respective straight lines a along the first strip lines. For example, the straight line a along the strip lines 7*a*-1 and 7*a*-2 is perpendicular to the slot 6*a* in such a manner that the line a passes through the central portion of the slot 6*a* in the longitudinal direction. This can be similarly said to the relation between the strip lines 7*b*-1 and 7*b*-2 and the slot 6*b*, the relation between the strip lines 7*c*-1 and 7*c*-2 and the slot 6*c*, and the relation between the strip lines 7*d*-1 and 7*d*-2 and the slot 6*d*.

Next, the operation will be described.

In the following, a case where the antenna device 1 is used as a transmission antenna will be described.

A high frequency power input from an RF connector to the feed 3 propagates through the signal line 4*a* from the feed 3. The branch lines 5*a* to 5*d* branched from the signal line 4*a* are each an open stub having a length one-fourth the wavelength of the working frequency of the antenna device 1, and the high frequency power propagating through the branch lines 5*a* to 5*d* are reflected. Therefore, the current is increased at the branch portions between the signal line 4*a* and the branch lines 5*a* to 5*d*.

Due to an increase in current at the branch portions, the slots 6*a* to 6*d* are excited, and further, due to electromagnetic coupling, the strip lines 7*a*-1 and 7*a*-2, the strip lines 7*b*-1 and 7*b*-2, the strip lines 7*c*-1 and 7*c*-2, and the strip lines 7*d*-1 and 7*d*-2 are excited to radiate electromagnetic waves into the space. Here, the strip lines 7*a*-1 and 7*a*-2, the strip lines 7*b*-1 and 7*b*-2, the strip lines 7*c*-1 and 7*c*-2, and the strip lines 7*d*-1 and 7*d*-2 are arranged in the +x direction, and thus, the electromagnetic wave radiated from the antenna device 1 has a polarized wave (along a y direction) perpendicular to the signal line 4*a*.

The case where the antenna device 1 is a traveling-wave antenna will be described in detail.

A portion of electric power not radiated from the strip lines 7*a*-1 and 7*a*-2 returns back to the feed 3 (in the −x direction) in the signal line 4*a* as a reflected wave, and the remaining electric power propagates through the signal line 4*a* in the +x direction. On the other hand, a portion of the electromagnetic waves propagating through the signal line 4*a* after passing through the branch line 5*a* excites the slot 6*b* intersecting with the branch line 5*b*, and is radiated to the space from the strip lines 7*b*-1 and 7*b*-2 by electromagnetic coupling. A portion of the electromagnetic waves not radiated into the space from the strip lines 7*b*-1 and 7*b*-2 returns back toward the feed 3 as a reflected wave, and the remaining electromagnetic waves propagate through the signal line 4*a* in the +x direction.

A portion of the electromagnetic waves propagating through the signal line 4*a* after passing through the branch line 5*b* excites the slot 6*c* intersecting with the branch line 5*c*, and is radiated to the space from the strip lines 7*c*-1 and 7*c*-2 by electromagnetic coupling. A portion of the electromagnetic waves not radiated into the space from the strip lines 7*c*-1 and 7*c*-2 returns back toward the feed 3 as a reflected wave, and the remaining electromagnetic waves propagate through the signal line 4*a* in the +x direction. Similarly, a portion of the electromagnetic waves propagating through the signal line 4*a* after passing through the branch line 5*c* excites the slot 6*d* intersecting with the branch line 5*d*, and is radiated to the space from the strip lines 7*d*-1 and 7*d*-2 by electromagnetic coupling. The remaining electromagnetic waves not radiated into the space from the strip lines 7*d*-1 and 7*d*-2 return back toward the feed 3 as reflected waves.

In the antenna device 1, the strip lines 7*a*-1 and 7*a*-2, the strip lines 7*b*-1 and 7*b*-2, the strip lines 7*c*-1 and 7*c*-2, and the strip lines 7*d*-1 and 7*d*-2 are supplied with electric power by electromagnetic coupling using the slots 6*a* to 6*d*. As a result, the antenna device 1 can efficiently radiate a polarized wave (along the y direction) perpendicular to the signal line 4*a* in the broadside direction. The case where the antenna device 1 is the transmission antenna has been described above. However, the antenna device 1 may be used as a reception antenna.

The total length of the conventional dipole antenna is generally about a half of the wavelength of the working frequency, and the width of the ground 4*b* of the antenna device 1 is shorter than the length of the dipole antenna. Thus, the antenna device 1 only needs to have a smaller area of the ground than the conventional dipole antenna. Therefore, when a dielectric substrate formed of a material having high light transmittance is used as the dielectric substrate 2, the antenna device 1 having high transparency can be achieved.

Next, a modification of the antenna device according to the first embodiment will be described.

Figure 2:
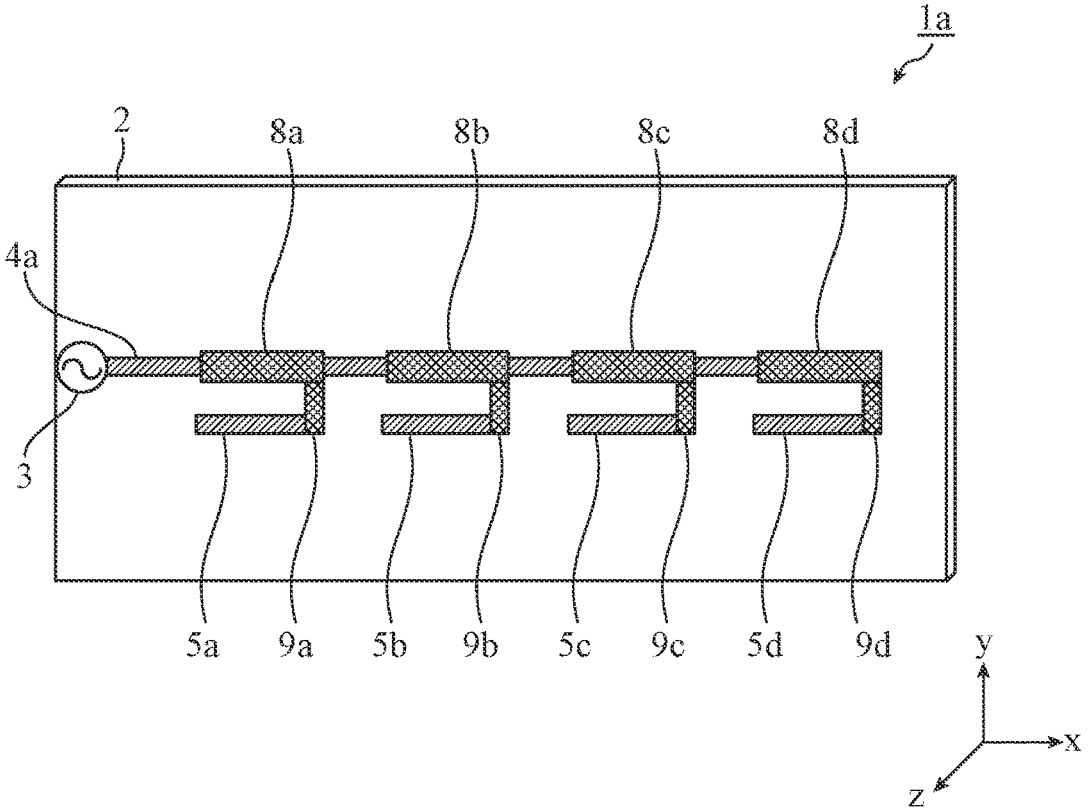
FIG. 2 is a perspective view showing a configuration of a modification of the antenna device according to the first embodiment.

FIG. 2 is a perspective view showing a configuration of an antenna device 1*a* which is a modification of the antenna device 1. FIG. 2 shows a front surface of the antenna device 1*a*. The components on the back surfaces of the antenna device 1 and the antenna device 1*a* are the same. The antenna device 1*a* includes transformers 8*a* to 8*d* and transformers 9*a* to 9*d* in order to adjust the amount of electric power to be distributed to the strip lines 7*a*-1 to 7*d*-1 and 7*a*-2 to 7*d*-2 and perform impedance matching.

As shown in FIG. 2, the transformers 8*a* to 8*d* are conductor patterns formed by widening the signal line 4*a*, and are first transformers extending toward the feed 3 from the branch portions of the branch lines 5*a* to 5*d*. The transformers 9*a* to 9*d* are conductor patterns connected to the transformers 8*a* to 8*d*, and are second transformers provided in the branch lines 5*a* to 5*d*, respectively.

The impedances of the signal line 4*a* and the branch lines 5*a* to 5*d* are transformed by the transformers 8*a* to 8*d* and the transformers 9*a* to 9*d*. This makes it possible to adjust the amount of electric power to be distributed to the strip lines 7*a*-1 to 7*d*-1 and 7*a*-2 to 7*d*-2 and perform impedance matching.

Although FIG. 2 shows the antenna device 1*a* including the transformers 8*a* to 8*d* and the transformers 9*a* to 9*d*, the antenna device may include either the transformers 8*a* to 8*d* or the transformers 9*a* to 9*d*.

Figure 3:
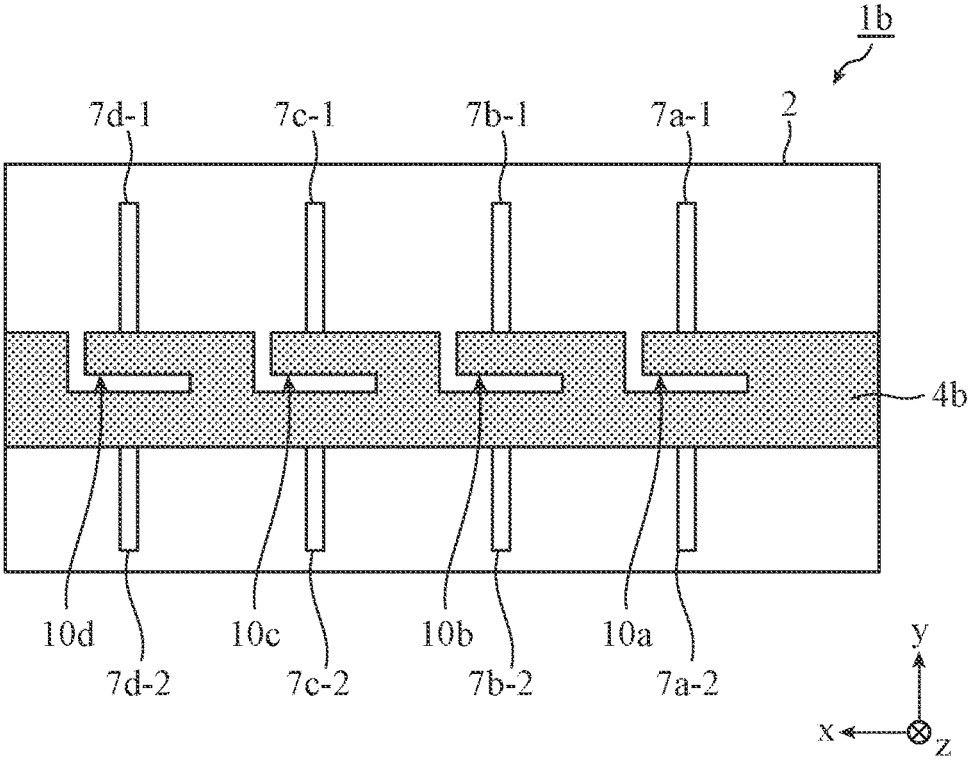
FIG. 3 is a plan view showing a configuration of a modification of the antenna device according to the first embodiment.

FIG. 3 is a plan view showing the configuration of an antenna device 1*b* which is a modification of the antenna device 1. FIG. 3 shows the back surface of the antenna device 1*b*. The components on the front surfaces of the antenna device 1 and the antenna device 1*b* are the same. Note that the front surface of the antenna device 1*b* may be configured as shown in FIG. 2. The antenna device 1*b* is provided with slits 10*a* to 10*d* instead of the slots 6*a* to 6*d* of the antenna device 1.

The slits 10*a* to 10*d* are holes that are partially opened. For example, each of the slits 10*a* to 10*d* has a shape in which the end on the side opposite to the feed 3 is opened in the direction along the strip line. Thus, even if partially opened holes are used as described above, excitation is possible, and similar to the antenna device 1, the antenna device 1*b* can efficiently radiate a polarized wave perpendicular to the signal line 4*a* in the broadside direction.

Figure 4:
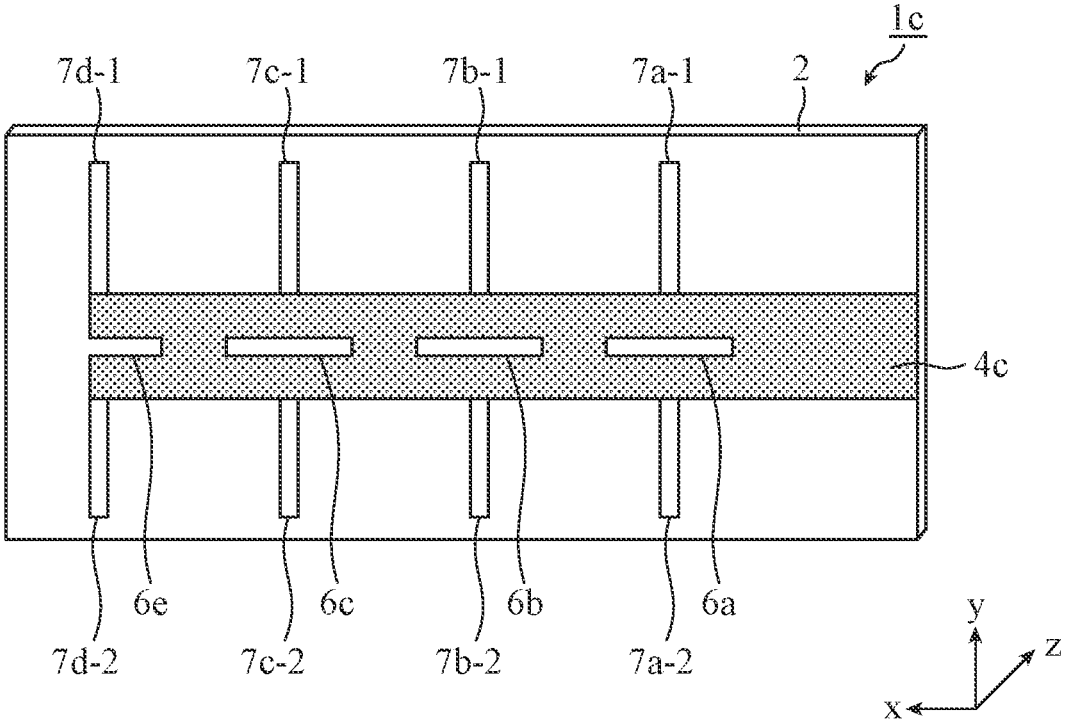
FIG. 4 is a perspective view showing a configuration of a modification of the antenna device according to the first embodiment.

FIG. 4 is a perspective view showing the configuration of an antenna device 1*c* which is a modification of the antenna device 1. FIG. 4 shows the back surface of the antenna device 1*c*. The components on the front surfaces of the antenna device 1 and the antenna device 1*c* are the same. Note that the front surface of the antenna device 1*c* may be configured as shown in FIG. 2. The antenna device 1*c* is provided with a ground 4*c* instead of the ground 4*b* in the antenna device 1.

The ground 4*c* is a strip-shaped first ground provided on the back surface of the dielectric substrate 2 at a position corresponding to the position of the signal line 4*a* on the front surface. The length of the ground 4*c* in the longitudinal direction is equal to the length from one end of the dielectric substrate 2 along the longitudinal direction of the ground 4*c* to the strip lines 7*d*-1 and 7*d*-2 which are the closest to the other end of the dielectric substrate 2, as shown in FIG. 4.

Slots 6*a* to 6*c* and a slit 6*e* are sequentially provided along the longitudinal direction of the ground 4*c*, and the slots 6*a* to 6*c* each have a rectangular hole shape that is long along the longitudinal direction of the ground 4*c*. The slit 6*e* is a hole that intersects with a straight line along the strip lines 7*d*-1 and 7*d*-2 closest to the other end of the dielectric substrate 2, and the end of the slit 6*e* on the other end side of the dielectric substrate 2 is open.

The ground 4*c* is shorter than the ground 4*b* of the antenna device 1 in the longitudinal direction. Accordingly, in the antenna device 1*c*, the area of the ground is further reduced.

Therefore, when a dielectric substrate formed of a material having high light transmittance is used as the dielectric substrate 2, the antenna device 1*c* can be configured to have higher transparency than the antenna device 1.

Next, characteristics of the antenna device according to the first embodiment will be described.

Figure 5:
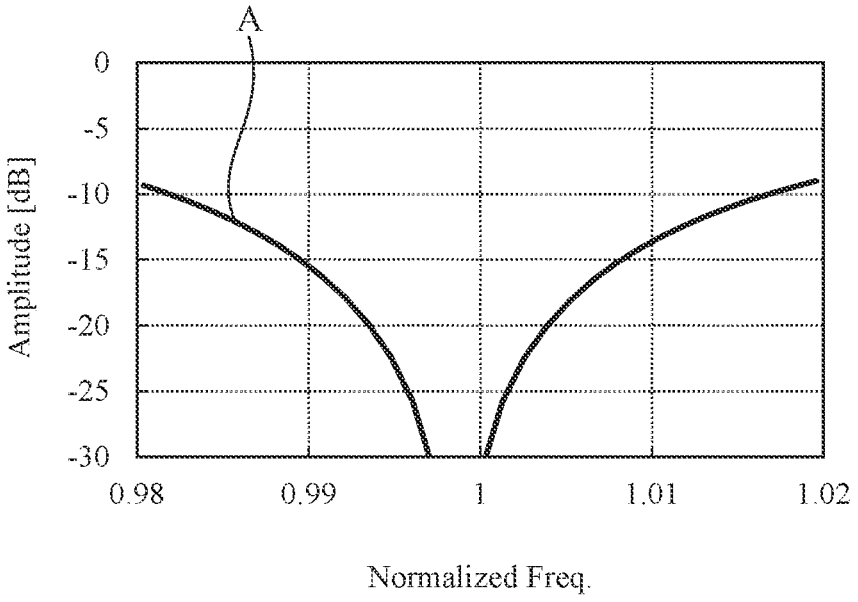
FIG. 5 is a graph showing a simulation result of electromagnetic field of the antenna device according to the first embodiment.

FIG. 5 is a graph showing a simulation result of an electromagnetic field of the antenna device according to the first embodiment, showing a result obtained by electromagnetic field simulation of electromagnetic wave radiation of the antenna device 1*a* shown in FIG. 2. As shown in FIG. 5, the relationship between the amplitude of the electromagnetic wave radiation of the antenna device 1*a* and the normalized frequency is indicated by a curve A. As is clear from the curve A, the reflection coefficient is smaller than about −10 dB over the bandwidth where the fractional bandwidth is equal to or more than 2%.

Figure 6:
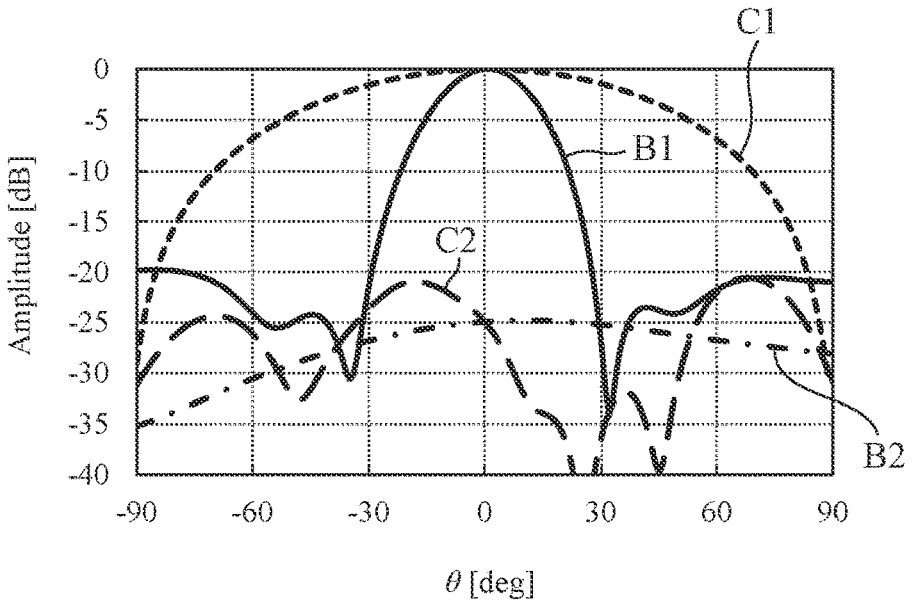
FIG. 6 is a graph showing a simulation result of electromagnetic fields of radiation patterns of electromagnetic waves radiated from the antenna device according to the first embodiment.

FIG. 6 is a graph showing a simulation result of electromagnetic fields of radiation patterns of electromagnetic waves radiated from the antenna device 1. In FIG. 6, a curve B1 represents main polarization in the yz plane in the radiation patterns of the electromagnetic waves radiated from the antenna device 1, and a curve B2 represents cross polarization in the yz plane. Further, a curve C1 represents main polarization in the xy plane in the radiation patterns of the electromagnetic waves radiated from the antenna device 1, and a curve C2 represents cross polarization in the xy plane. The portion where θ is 0 degrees corresponds to the +z direction shown in FIG. 1. As shown in FIG. 6, the antenna device 1 can radiate a polarized wave perpendicular to the signal line 4*a* in the broadside direction (+z direction and −z direction).

The configuration in which the signal line 4*a*, the ground 4*b* or the ground 4*c*, the branch lines 5*a* to 5*d*, and the strip lines 7*a*-1 to 7*d*-1 and 7*a*-2 to 7*d*-2 are conductor patterns formed on the dielectric substrate 2 has been described above. However, the first embodiment is not limited thereto.

For example, the antenna device may have a structure in which the signal line 4*a*, the ground 4*b* or the ground 4*c*, the branch lines 5*a* to 5*d*, and the strip lines 7*a*-1 to 7*d*-2 and 7*a*-2 to 7*d*-2 are composed of metal conductors, and a spacer is used instead of the dielectric substrate 2. The antenna device having such structure can also efficiently radiate a polarized wave perpendicular to the signal line 4*a* in the broadside direction.

In the above description, each slot has a hole shape which is rectangular and long along the longitudinal direction of the ground 4*b* or the ground 4*c*. However, each slot may have a circular shape, an elliptical shape, or a polygonal shape.

Figure 1C:
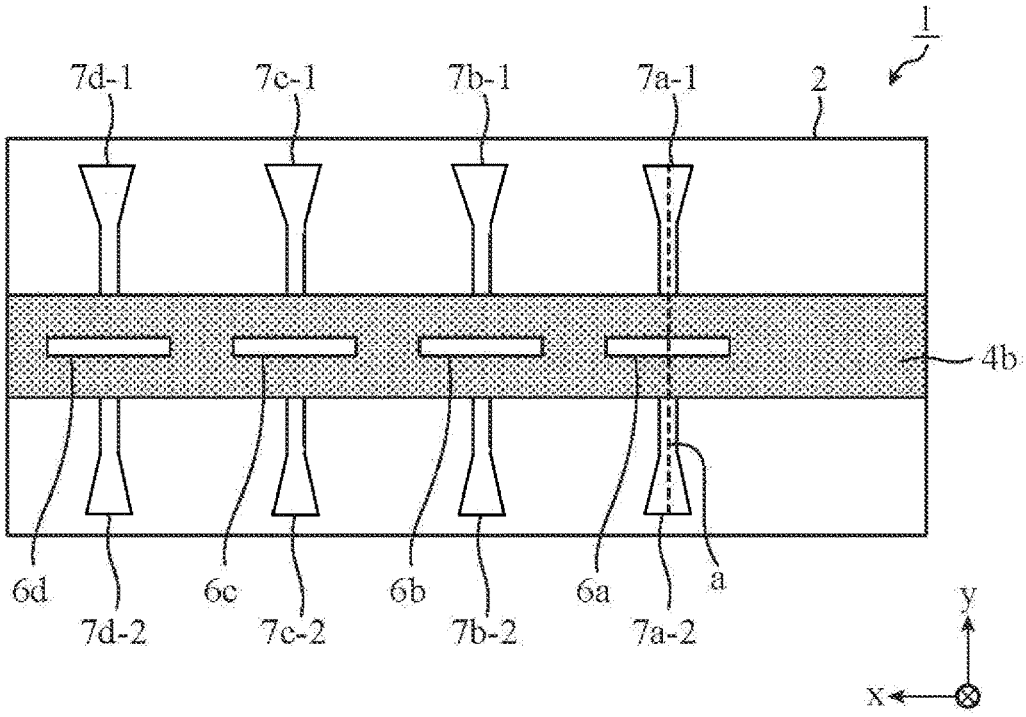
FIG. 1C is a plan view showing a configuration of the back surface side of the antenna device according to a first alternate version of the first embodiment of the present invention.

Each of the strip lines 7*a*-1 to 7*d*-1 and 7*a*-2 to 7*d*-2 may be a conductor pattern that is widened toward the leading end as shown in FIG. 1C. When each of the strip lines 7*a*-1 to 7*d*-1 and 7*a*-2 to 7*d*-2 is widened toward the leading end, the bandwidth of the antenna device can be broadened.

Figure 1D:
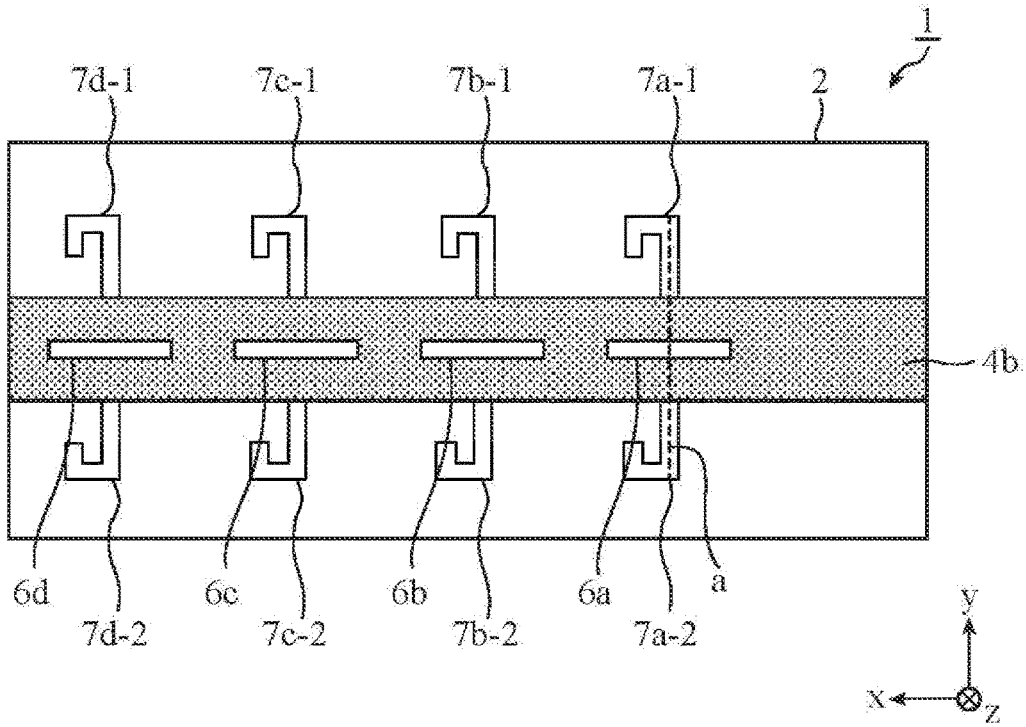
FIG. 1D is a plan view showing a configuration of the back surface side of the antenna device according to a second alternate version of the first embodiment of the present invention.

Each of the strip lines 7*a*-1 to 7*d*-1 and 7*a*-2 to 7*d*-2 may be a conductor pattern in which the leading end is folded back as shown in FIG. 1D. When each of the strip lines 7*a*-1 to 7*d*-1 and 7*a*-2 to 7*d*-2 has a shape in which the leading end is folded back, the length of each of the strip lines 7*a*-1 to 7*d*-1 and 7*a*-2 to 7*d*-2 in the y direction can be decreased, whereby the antenna device can be downsized.

The antenna devices 1 and 1*a* to 1*c* may be provided with a polarizer. For example, the polarizer is disposed in parallel with the radiation direction of the electromagnetic wave of each of the antenna devices. This allows the antenna devices to operate as circularly polarized antennas.

Figure 7:
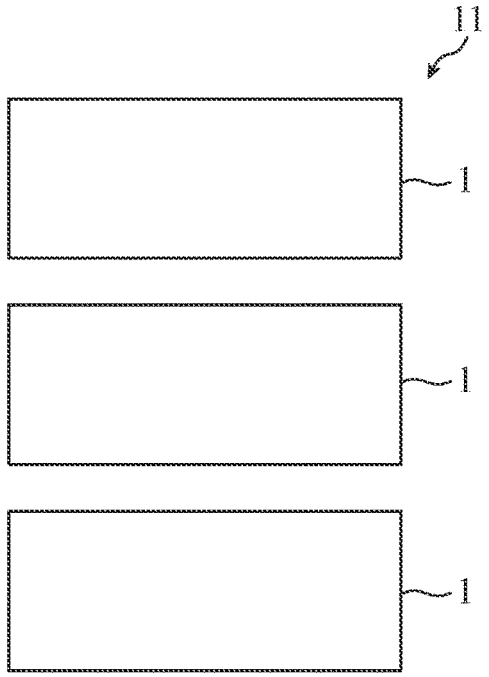
FIG. 7 is a plan view showing a configuration of an array antenna according to the first embodiment.

An array antenna according to the first embodiment is a planar array antenna including a plurality of antenna devices according to the first embodiment. FIG. 7 is a plan view showing the configuration of the array antenna according to the first embodiment. In FIG. 7, an array antenna 11 includes three antenna devices 1. The three antenna devices 1 are arranged in parallel along the width direction of the ground 4*b*. In this way, the planar array antenna can be achieved by using a plurality of antenna devices 1.

Further, a phased array antenna capable of scanning a beam in an arbitrary direction can be achieved by individually supplying electric power to each antenna device 1 in the array antenna 11. Although FIG. 7 shows the array antenna 11 using the plurality of antenna devices 1, the array antenna according to the first embodiment can also be configured by using a plurality of any of the antenna devices 1*a* to 1*c*. For example, a plurality of antenna devices 1*c* may be arranged in parallel along the width direction of the ground 4*c* to form an array antenna. Further, the antenna device 1, the antenna device 1*a*, and the antenna device 1*b* may be arranged in parallel along the width direction of the ground 4*b* to form an array antenna.

As described above, the antenna device 1 according to the first embodiment has the ground 4*b* having a strip shape parallel to the signal line 4*a*, the strip lines 7*a*-1 to 7*d*-1 and 7*a*-2 to 7*d*-2 each extending from the ground 4*b*, slots 6*a* to 6*d* intersecting with respective straight lines along the strip lines 7*a*-1 to 7*d*-1 and 7*a*-2 to 7*d*-2, and branch lines 5*a* to 5*d*, each of the branch lines 5*a* to 5*d* intersecting with the corresponding slot 6*a* to 6*d* located on the back surface as viewed transparently from the front surface side. The current in the branch portions where the branch lines 5*a* to 5*d* are branched from the signal line 4*a* is increased, whereby the strip lines 7*a*-1 to 7*d*-1 and 7*a*-2 to 7*d*-2 are supplied with electric power by electromagnetic coupling using the slots 6*a* to 6*d*. Thus, the antenna device 1 can efficiently radiate a polarized wave perpendicular to the signal line 4*a* in the broadside direction.

The antenna device 1*a* according to the first embodiment includes transformers 8*a* to 8*d* provided in the signal line 4*a* and transformers 9*a* to 9*d* provided in the branch lines 5*a* to 5*d*. Due to these components, the antenna device 1*a* can adjust the amount of electric power to be distributed to the strip lines 7*a*-1 to 7*d*-1 and 7*a*-2 to 7*d*-2 and perform impedance matching.

The antenna device 1*b* according to the first embodiment includes slits 10*a* to 10*d*. Similar to the antenna device 1, the antenna device 1*b* can efficiently radiate a polarized wave perpendicular to the signal line 4*a* in the broadside direction, even if the slots 6*a* to 6*d* are replaced with the slits 10*a* to 10*d*.

In the antenna device 1*c* according to the first embodiment, the length of the ground 4*c* in the longitudinal direction is equal to the length from one end of the dielectric substrate 2 along the longitudinal direction of the ground 4*c* to the strip lines 7*d*-1 and 7*d*-2 which are the closest to the other end of the dielectric substrate 2. The slit 6*e* that intersects with a straight line along the strip lines 7*d*-1 and 7*d*-2 closest to the other end of the dielectric substrate 2 is open on the other end side of the dielectric substrate 2. The ground 4*c* is shorter than the ground 4*b* in the longitudinal direction, and therefore, the area of the ground is further reduced. This configuration enables the antenna device 1*c* to have high transparency.

The array antenna 11 according to the first embodiment includes a plurality of antenna devices 1 and 1*a* to 1*c* which is arranged in parallel along the width direction of the ground 4*b* or 4*c*. Accordingly, a planar array antenna can be constructed.

Second Embodiment

Figure 8:
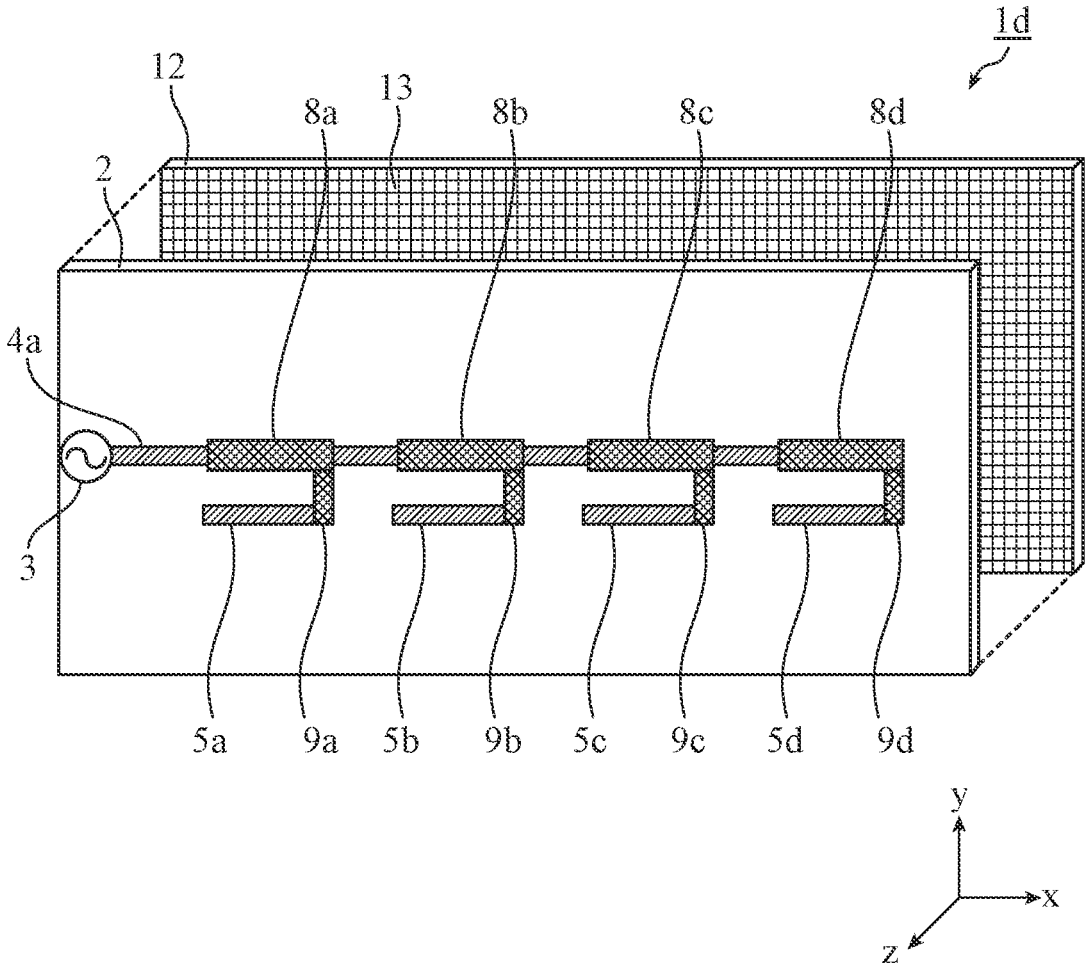
FIG. 8 is a perspective view showing a configuration of an antenna device according to a second embodiment of the present invention.

FIG. 8 is a perspective view showing the configuration of an antenna device 1*d* according to the second embodiment of the present invention, and shows the front surface of the antenna device 1*d*. In FIG. 8, the antenna device 1*d* includes a dielectric substrate 2 that is a first dielectric substrate, conductor patterns formed on both surfaces of the dielectric substrate 2, a dielectric substrate 12 that is a second dielectric substrate, and a ground 13 provided on the dielectric substrate 12. In the antenna device 1*d* shown in FIG. 8, the dielectric substrate 2 and the conductor patterns formed on both surfaces of the dielectric substrate 2 are the same as those shown in FIGS. 1 and 2.

The dielectric substrate 12 is disposed in parallel with and apart from the dielectric substrate 2. For example, the dielectric substrate 12 is disposed apart from the dielectric substrate 2 in the −z direction by about a quarter wavelength.

The ground 13 is a second ground provided on the surface of the dielectric substrate 12 that faces the back surface of the dielectric substrate 2. The ground 13 may be a solid ground provided on the entire surface of the dielectric substrate 12, or may be a mesh-shaped ground.

As described above, the antenna device according to the first embodiment can efficiently radiate a polarized wave perpendicular to the signal line 4*a* in the broadside direction. However, the beam of electromagnetic waves emitted from the antenna device is formed on both the +z side and the −z side.

On the other hand, in the antenna device 1*d* according to the second embodiment, the dielectric substrate 12 is disposed apart from the dielectric substrate 2 by a quarter wavelength in the −z direction, and the ground 13 is provided on the surface of the dielectric substrate 12 facing the back surface of the dielectric substrate 2.

The beam of the electromagnetic waves emitted from the antenna device 1*d* is limited to be formed in the +z direction by the ground 13 of the dielectric substrate 12. Therefore, the antenna device 1*d* can form a sharper beam than the antenna device according to the first embodiment, and can limit the radiation direction of electromagnetic waves to one direction.

The holes provided in the first ground of the antenna device 1*d* may be the slots 6*a* to 6*d* and the slit 6*e* described in the first embodiment. The shape of the slot may be circular, elliptical or polygonal. Further, the holes provided in the first ground in the antenna device 1*d* may be the slits 10*a* to 10*d* described in the first embodiment instead of the slots.

Furthermore, the first strip lines in the antenna device 1*d* may be the strip lines 7*a*-1 to 7*d*-1 and 7*a*-2 to 7*d*-2 described in the first embodiment. Each of the strip lines may be widened toward the leading end, or may be folded at the leading end as shown in FIGS. 1C and 1D, respectively. When each of the strip lines is widened toward the leading end, the bandwidth of the antenna device 1*d* can be broadened. When each of the strip lines is folded at the leading end, the antenna device 1*d* can be downsized.

The antenna device 1*d* may be provided with a polarizer. For example, the polarizer is disposed in parallel with the radiation direction of the electromagnetic wave of the antenna device 1*d*. This allows the antenna device 1*d* to operate as a circularly polarized antenna.

An array antenna according to the second embodiment is a planar array antenna including a plurality of antenna devices 1*d*. For example, the planar array antenna is constructed by arranging a plurality of antenna devices 1*d* in parallel along the width direction of the ground 4*b*.

As described above, the antenna device 1*d* according to the second embodiment includes the dielectric substrate 12 disposed in parallel with and apart from the dielectric substrate 2, and the ground 13 provided on the surface of the dielectric substrate 12 facing the back surface of the dielectric substrate 2. With this configuration, the antenna device 1*d* can form a sharper beam than the antenna device according to the first embodiment, and can limit the radiation direction of electromagnetic waves to one direction.

In the antenna device 1*d* according to the second embodiment, the ground 13 has a mesh shape. This configuration enables the antenna device 1*d* to have higher transparency by using a dielectric substrate having higher light transmission as the dielectric substrate 12.

Third Embodiment

Figure 9:
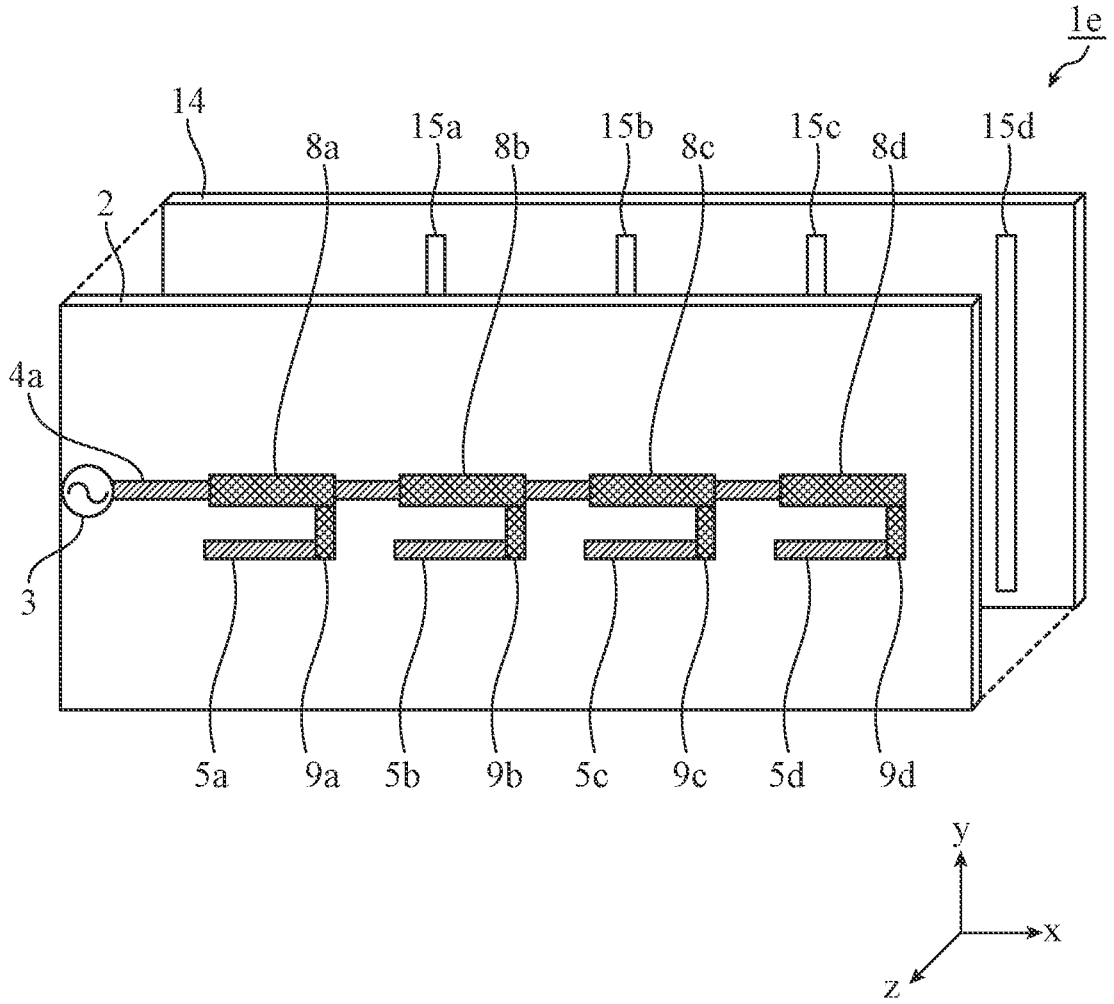
FIG. 9 is a perspective view showing a configuration of an antenna device according to a third embodiment of the present invention.

FIG. 9 is a perspective view showing the configuration of an antenna device 1*e* according to the third embodiment of the present invention, and shows the front surface of the antenna device 1*e*. In FIG. 9, the antenna device 1*e* includes a dielectric substrate 2 that is a first dielectric substrate, conductor patterns formed on both surfaces of the dielectric substrate 2, a dielectric substrate 14 that is a third dielectric substrate, and a conductor pattern provided on the dielectric substrate 14. In the antenna device 1*e* shown in FIG. 9, the dielectric substrate 2 and the conductor patterns formed on both surfaces of the dielectric substrate 2 are the same as those shown in FIGS. 1 and 2.

The dielectric substrate 14 is disposed in parallel with and apart from the dielectric substrate 2. For example, the dielectric substrate 14 is disposed apart from the dielectric substrate 2 in the −z direction by about a quarter wavelength. The dielectric substrate 14 has strip lines 15*a* to 15*d* provided on the surface facing the back surface of the dielectric substrate 2. The strip lines 15*a* to 15*d* are second strip lines provided to face the strip lines 7*a*-1, 7*a*-2 to 7*d*-1, and 7*d*-2 provided on the dielectric substrate 2.

For example, a beam of an electromagnetic wave radiated from the strip lines 7*a*-1 and 7*a*-2 is limited to be formed in the +z direction by the strip line 15*a* provided on the dielectric substrate 14 at the position facing the strip lines 7*a*-1 and 7*a*-2. In this way, the radiation direction of beams of the electromagnetic waves emitted from the antenna device 1*e* is limited to the +z direction by the strip lines 15*a* to 15*d* provided on the dielectric substrate 14. Therefore, the antenna device 1*e* can form a sharper beam than the antenna device according to the first embodiment, and can limit the radiation direction of electromagnetic waves to one direction.

Further, since the strip lines 15*a* to 15*d* have a smaller area of conductor patterns than the ground 13 shown in the second embodiment, the antenna device 1*e* having high transparency can be achieved.

The holes provided in the first ground of the antenna device 1*e* may be the slots 6*a* to 6*d* and the slit 6*e* described in the first embodiment. The shape of the slot may be circular, elliptical or polygonal. Further, the holes provided in the first ground in the antenna device 1*e* may be the slits 10*a* to 10*d* described in the first embodiment instead of the slots.

Each of the first strip lines and the second strip lines in the antenna device 1*e* may have a conductor pattern which is widened toward the leading end or which is folded at the leading end as shown in FIGS. 1C and 1D respectively. When each of the strip lines is widened toward the leading end, the bandwidth of the antenna device 1*e* can be broadened. When each of the strip lines is folded at the leading end, the antenna device 1*e* can be downsized.

The antenna device 1*e* may be provided with a polarizer. For example, the polarizer is disposed in parallel with the radiation direction of the electromagnetic wave of the antenna device 1*e*. This allows the antenna device 1*e* to operate as a circularly polarized antenna.

An array antenna according to the third embodiment is a planar array antenna including a plurality of antenna devices 1*e*. For example, the planar array antenna is constructed by arranging a plurality of antenna devices 1*e* in parallel along the width direction of the ground 4*b*.

As described above, the antenna device 1*e* according to the third embodiment includes the dielectric substrate 14 disposed in parallel with and apart from the dielectric substrate 2, and the strip lines 15*a* to 15*d* provided on the dielectric substrate 14. The strip lines 7*a*-1 to 7*d*-1 and 7*a*-2 to 7*d*-2 provided on the dielectric substrate 2 face the strip lines 15*a* to 15*d* provided on the dielectric substrate 14, respectively.

With this configuration, the antenna device 1*e* can form a sharper beam than the antenna device according to the first embodiment, and can limit the radiation direction of electromagnetic waves to one direction.

The present invention is not limited to the above embodiments, and two or more of the above embodiments can be freely combined, or arbitrary components in the embodiments can be modified or omitted, within the scope of the present invention.

INDUSTRIAL APPLICABILITY

The antenna device according to the present invention can efficiently radiate a polarized wave perpendicular to the signal line in the broadside direction, and thus can be used in, for example, a radar and a wireless communication device.

REFERENCE SIGNS LIST

1, 1*a*, 1*b*, 1*c*, 1*d*, 1*e*: antenna device, 2, 12, 14: dielectric substrate, 3: feed, 4*a*: signal line, 4*b*, 4*c*, 13: ground, 5*a*, 5*b*, 5*c*, 5*d*: branch line, 6*a*, 6*b*, 6*c*, 6*d*: slot, 7*a*-1 to 7*d*-1, 7*a*-2 to 7*d*-2, 15*a*, 15*b*, 15*c*, 15*d*: strip line, 8*a*, 8*b*, 8*c*, 8*d*, 9*a*, 9*b*, 9*c*, 9*d*: transformer, 6*e*, 10*a*, 10*b*, 10*c*, 10*d*: slit, 11: array antenna

The invention claimed is:

1. An antenna device comprising:

a first ground provided on a first surface and having a strip shape;

a plurality of first strip lines provided on the first surface, each of the first strip lines being disposed along a longitudinal direction of the first ground;

a plurality of holes provided in the first ground;

a signal line provided on a second surface facing opposite to the first surface, the signal line disposed at a position corresponding to the first ground, and through which a high frequency wave propagates;

a plurality of branch lines provided on the second surface and branched from the signal line; wherein the strip shape of the first ground is parallel to the signal line, each of the first strip lines is a strip line extending from the first ground, each of the holes intersects with a straight line along a corresponding one of the first strip lines, the signal line intersects with each of the straight lines along the corresponding plurality of first strip lines, and each of the branch lines is disposed along a longitudinal direction of the first ground with respect to the signal line and intersects with a corresponding one of the holes located on the first surface when viewed transparently from the second surface side.

2. An antenna device comprising:

a first ground provided on a first surface and having a strip shape;

a plurality of first strip lines provided on the first surface, each first strip lines being disposed along a longitudinal direction of the first ground;

a plurality of holes provided in the first ground;

a signal line provided on a second surface facing opposite to the first surface, the signal line being disposed at a position corresponding to the first ground;

a plurality of branch lines provided on the second surface and branched from the signal line; wherein the strip shape of the first ground is parallel to the signal line, each of the first strip lines is a strip line extending from the first ground, each of the holes intersects with a straight line along a corresponding one of the first strip lines, the hole being partially opened, the signal line intersects with each of the straight lines along the corresponding plurality of first strip lines, and each of the branch lines intersects with a corresponding one of the holes located on the first surface when viewed transparently from the second surface side.

3. The antenna device according to claim 1, wherein the first surface is one surface of a first dielectric substrate, and the second surface is the other surface of the first dielectric substrate.

4. An antenna device comprising:

a first ground provided on a first surface and having a strip shape;

a plurality of first strip lines provided on the first surface, each of the first strip lines being disposed along a longitudinal direction of the first ground;

a plurality of holes provided in the first ground;

a signal line provided on a second surface facing opposite to the first surface, the signal line being disposed at a position corresponding to the first ground;

a plurality of branch lines provided on the second surface and branched from the signal line; wherein the first surface is one surface of a dielectric substrate, the second surface is the other surface of the dielectric substrate, the strip shape of the first ground is parallel to the signal line, the length of the first ground in the longitudinal direction is equal to the length from one end of the dielectric substrate along the longitudinal direction of the first ground to the strip line closest to the other end of the dielectric substrate, each of the first strip lines is a strip line extending from the first ground, each of the holes intersects with a straight line along a corresponding one of the first strip lines, one of the holes that intersects with a straight line along the strip line closest to the other end of the dielectric substrate is open on the other end side of the dielectric substrate, the signal line intersects with each of the straight lines along the corresponding plurality of first strip lines, and each of the branch lines is disposed along a longitudinal direction of the first ground and intersects with a corresponding one of the holes located on the first surface when viewed transparently from the second surface side.

5. The antenna device according to claim 1, wherein the first and second surfaces are part of a first dielectric substrate; and the antenna device further comprises:

a second dielectric substrate disposed in parallel with and apart from the first dielectric substrate; and a second ground disposed on a surface of the second dielectric substrate, the surface of the second dielectric substrate facing the first surface of the first dielectric substrate.

6. The antenna device according to claim 5, wherein the second ground is a mesh shaped ground.

7. The antenna device according to claim 1, wherein the first and second surfaces are part of a first dielectric substrate; and the antenna device further comprises:

a third dielectric substrate disposed in parallel with and apart from the first dielectric substrate; and a plurality of second strip lines arranged on a surface of the third dielectric substrate, the surface of the third dielectric substrate facing the first surface of the first dielectric substrate;

wherein each of the first strip lines is facing a corresponding one of the second strip lines.

8. The antenna device according to claim 7, wherein each shape of the first strip lines and the second strip lines is gradually widened toward an end.

9. The antenna device according to claim 7, wherein each shape of the first strip lines and the second strip lines includes an end that is folded back toward an opposite end.

10. The antenna device according to claim 1, wherein the antenna device further comprises a first transformer provided in the signal line.

11. The antenna device according to claim 1, wherein the antenna device further comprises a second transformer provided in the branch line.

12. An array antenna comprising a plurality of the antenna devices according to claim 1, wherein each of the antenna devices is disposed in parallel along a width direction of the first ground.

* * * * *